US008186663B2

(12) United States Patent
Suzuki et al.

(10) Patent No.: US 8,186,663 B2
(45) Date of Patent: May 29, 2012

(54) SPINE FORMATION DEVICE, SADDLE-STITCH BOOKBINDING APPARATUS, SHEET-EDGE CUTTING APPARATUS, SHEET PROCESSING APPARATUS, AND IMAGE FORMING APPARATUS

(75) Inventors: Nobuyoshi Suzuki, Tokyo (JP); Shinji Asami, Machida (JP); Naohiro Kikkawa, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 169 days.

(21) Appl. No.: 12/659,642

(22) Filed: Mar. 16, 2010

(65) Prior Publication Data

US 2010/0239393 A1 Sep. 23, 2010

(30) Foreign Application Priority Data

Mar. 18, 2009 (JP) ..... 2009-066554
Oct. 30, 2009 (JP) ..... 2009-250802

(51) Int. Cl.
*B65H 37/04* (2006.01)
*B31F 1/00* (2006.01)

(52) U.S. Cl. ..... 270/45; 270/32; 270/37; 270/51; 270/58.07

(58) Field of Classification Search ..... 270/32, 270/37, 45, 51, 58.07, 58.11; 412/22, 23
See application file for complete search history.

(56) References Cited

U.S. PATENT DOCUMENTS

| | | | | |
|---|---|---|---|---|
| 6,692,208 | B1 * | 2/2004 | Watkiss et al. | 412/1 |
| 7,147,598 | B2 * | 12/2006 | Fujimoto et al. | 493/405 |
| 7,416,177 | B2 | 8/2008 | Suzuki | |
| 7,594,645 | B2 * | 9/2009 | Suzuki et al. | 270/37 |
| 2006/0055100 | A1 | 3/2006 | Suzuki | |
| 2008/0067730 | A1 | 3/2008 | Suzuki | |
| 2008/0179809 | A1 | 7/2008 | Kikkawa | |
| 2008/0211162 | A1 | 9/2008 | Suzuki | |
| 2008/0284092 | A1 | 11/2008 | Suzuki | |
| 2009/0200725 | A1 | 8/2009 | Tamura | |
| 2009/0258774 | A1 | 10/2009 | Suzuki | |
| 2010/0258994 | A1 * | 10/2010 | Kikkawa et al. | 270/37 |

FOREIGN PATENT DOCUMENTS

JP 2001-260564 9/2001

* cited by examiner

*Primary Examiner* — Leslie A Nicholson, III
(74) *Attorney, Agent, or Firm* — Harness, Dickey & Pierce, P.L.C.

(57) ABSTRACT

A spine formation device includes a sheet conveyer, a presser, and a spine formation member. The sheet conveyer conveys a bundle of folded sheets with a folded portion of the bundle of sheets forming a front end portion of the bundle of sheets. The presser is disposed downstream from the sheet conveyer in a sheet conveyance direction in which the sheet conveyer conveys the bundle of sheets. The presser is movable to press opposed sides of the front end portion of the bundle of sheets. The spine formation member is movably disposed downstream from the presser in the sheet conveyance direction. The spine formation member includes a groove portion that contacts and positions the bundle of sheets to define an amount by which the bundle of sheets protrudes from the presser and a spine formation face that forms a spine at the folded portion of the bundle of sheets.

8 Claims, 7 Drawing Sheets

SPINE FORMATION DEVICE, SADDLE-STITCH BOOKBINDING APPARATUS, SHEET-EDGE CUTTING APPARATUS, SHEET PROCESSING APPARATUS, AND IMAGE FORMING APPARATUS

CROSS-REFERENCE TO RELATED APPLICATIONS

The present patent application claims priority pursuant to 35 U.S.C. §119 from Japanese Patent Application Nos. 2009-066554, filed on Mar. 18, 2009 and 2009-250802, filed on Oct. 30, 2009 in the Japan Patent Office, each of which is incorporated herein by reference in its entirety.

BACKGROUND OF THE INVENTION

1. Field of the Invention

Illustrative embodiments of the present disclosure relate to a device capable of reducing bulging of a saddle-stitched booklet or a bundle of two-folded sheets, a system or device built into a folding device or a saddle-stitching device, a spine formation device that is built into a post processing device connected to the foregoing system or device to perform post processing, such as cutting, on a bound book and forms a spine of the bound book, and a system or apparatus including the spine formation device.

2. Description of the Background

As a technique for straightening the spine of a booklet, for example, a conventional approach like that described in JP-2001-260564-A is known. The conventional apparatus includes a clamping unit disposed to hold and fix a bundle of sheets (hereinafter "booklet"), folded so that a spine portion of the booklet protrudes from the clamp unit, and a spine forming unit movable in a longitudinal direction of the spine portion of the booklet to press the spine and flatten it. By using the clamping unit and the spine forming unit, the spine of the booklet is flattened (deformed) to reduce bulging of the booklet. This reformation is important for ease of storage and transport because the curved spine causes the booklets to bulge and bulging booklets can be difficult to stack, making it difficult to store or carry them. In the above-mentioned approach, such bulging is reduced by flattening the spine of the booklet so as to eliminate such inconvenience.

The above-described approach is now described in further detail with reference to FIGS. 11-13. It can be seen that the amount by which the spine protrudes from the clamping unit 12 is regulated by a flat stopper 14. However, in such a configuration, the sheets are freely movable in a space between the clamping unit 12 and the stopper 14 as shown in FIGS. 11 and 12. Consequently, during positioning, a folded portion of the booklet 13 may shift position as indicated by a circle area "A" illustrated in FIG. 11. If the clamping unit 12 clamps the booklet 13 and flattens the spine of the booklet 13 with a spine forming unit 18, the spine may be deformed in an irregular shape as illustrated in FIG. 12.

The spine forming unit 18 is movable in the longitudinal direction of the protruding portion of the booklet and applies enough pressure to the spine to flatten the curvature of the spine. Although controlled during spine formation, the pressure needed to flatten the curvature of the spine fluctuates continuously and substantially. Consequently, the distance between the spine forming unit 18 and the booklet also continuously fluctuates, thus preventing the spine from being flattened. In fact, as indicated by a portion "B" illustrated in FIG. 13, the spine may be made wavy rather than straight, thus detracting from the booklet's appearance.

SUMMARY OF THE INVENTION

In one illustrative embodiment, a spine formation device includes a sheet conveyer, a presser, and a spine formation member. The sheet conveyer conveys a bundle of folded sheets with a folded portion of the bundle of folded sheets forming a front end portion of the bundle of folded sheets. The presser is disposed downstream from the sheet conveyer in a sheet conveyance direction in which the sheet conveyer conveys the bundle of folded sheets. The presser is movable to press opposed sides of the front end portion of the bundle of folded sheets conveyed with the sheet conveyer. The spine formation member is movably disposed downstream from the presser in the sheet conveyance direction. The spine formation member includes a groove portion and a spine formation face. The groove portion contacts and positions the bundle of folded sheets to define an amount by which the bundle of folded sheets protrudes from the presser. The spine formation face forms a spine at the folded portion of the bundle of folded sheets.

In another illustrative embodiment, an image forming apparatus includes a spine formation device. The spine formation device includes a sheet conveyer, a presser, and a spine formation member. The sheet conveyer conveys a bundle of folded sheets with a folded portion of the bundle of folded sheets forming a front end portion of the bundle of folded sheets. The presser is disposed downstream from the sheet conveyer in a sheet conveyance direction in which the sheet conveyer conveys the bundle of folded sheets. The presser is movable to press opposed sides of the front end portion of the bundle of folded sheets conveyed with the sheet conveyer. The spine formation member is movably disposed downstream from the presser in the sheet conveyance direction. The spine formation member includes a groove portion and a spine formation face. The groove portion contacts and positions the bundle of folded sheets to define an amount by which the bundle of folded sheets protrudes from the presser. The spine formation face forms a spine at the folded portion of the bundle of folded sheets.

In still another illustrative embodiment, A spine formation device includes conveying means, pressing means, and spine formation means. The conveying means conveys a bundle of folded sheets with a folded portion of the bundle of folded sheets forming a front end portion of the bundle of folded sheets. The pressing means presses a front end portion of the bundle of folded sheets conveyed with the conveying means in a sheet conveyance direction. The spine formation means forms a spine at the folded portion of the bundle of folded sheets. The spine formation means includes a groove portion for positioning the bundle of folded sheets and defines an amount by which the bundle of folded sheets protrudes from the pressing means and a spine formation face for forming a spine at the folded portion of the bundle of folded sheets.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
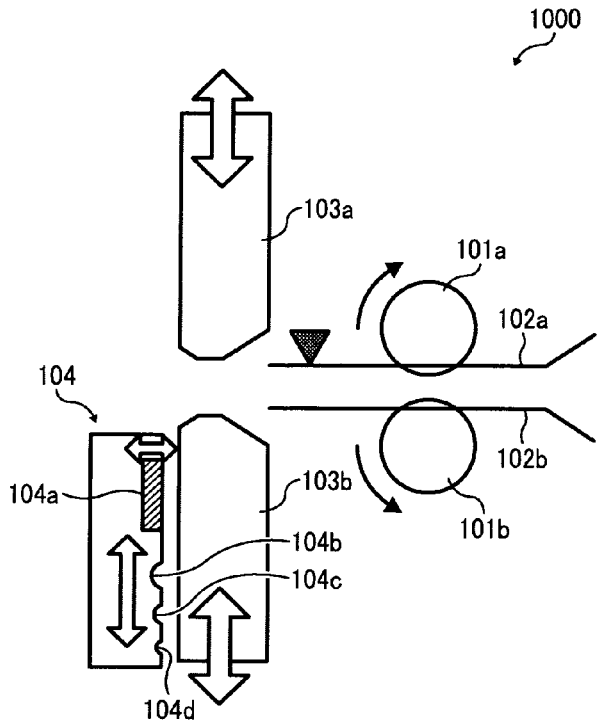
FIG. 1 is a plan view illustrating a configuration of a spine formation device according to an illustrative embodiment.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, illustrative embodiments according to the present disclosure are described with reference to attached drawings.

FIG. 1 is a plan view illustrating a configuration of a spine formation device 1000 according to an illustrative embodiment.

In FIG. 1, the spine formation device 1000 includes an upper guide plate 102*a*, a lower guide plate 102*b*, an upper conveyance roller 101*a*, a lower conveyance roller 101*b*, an upper press board 103*a*, a lower press board 103*b*, and a spine formation board 104. The upper conveyance roller 101*a* and the lower conveyance roller 101*b* are disposed at the upper press board 103*a* and the lower guide plate 102*b*, respectively. The upper press board 103*a* is disposed above a downstream portion of an output opening between the guide plates 102 and the lower press board 103*b* is disposed below the downstream portion of the sheet output opening of the guide plates 102. The spine formation board 104 serving as a spine formation member is disposed at an exit of a press region between the upper press board 103*a* and the lower press board 103*b*. In the present illustrative embodiment, indices of "a" and "b" are attached to the respective pieces of each pair component. However, when collectively referring to such component pieces, the indices of "a" and "b" are omitted and only the number code is attached to the component name for simplicity.

On one side of the spine formation board 104 opposing the press boards 103, a spine formation face 104*a*, a first positioning groove 104*b* for 21 to 30 sheets, a second positioning groove 104*c* for 11 to 20 sheets, and a third positioning groove 104*d* for 1 to 10 sheets are formed in this order from an upper portion to a lower portion thereof. The upper press board 103*a* and the lower press board 103*b* are driven with a driving mechanism to move toward and away from each other. By moving toward each other, the upper press board 103*a* and the lower press board 103*b* sandwich and press a bundle of sheets (hereinafter also referred to as "booklet"). The spine formation board 104 is driven with a driving mechanism to move up and down and move toward and away from the press boards 103. The driving mechanisms include, e.g., a switching controller and driving motors.

Figure 8:
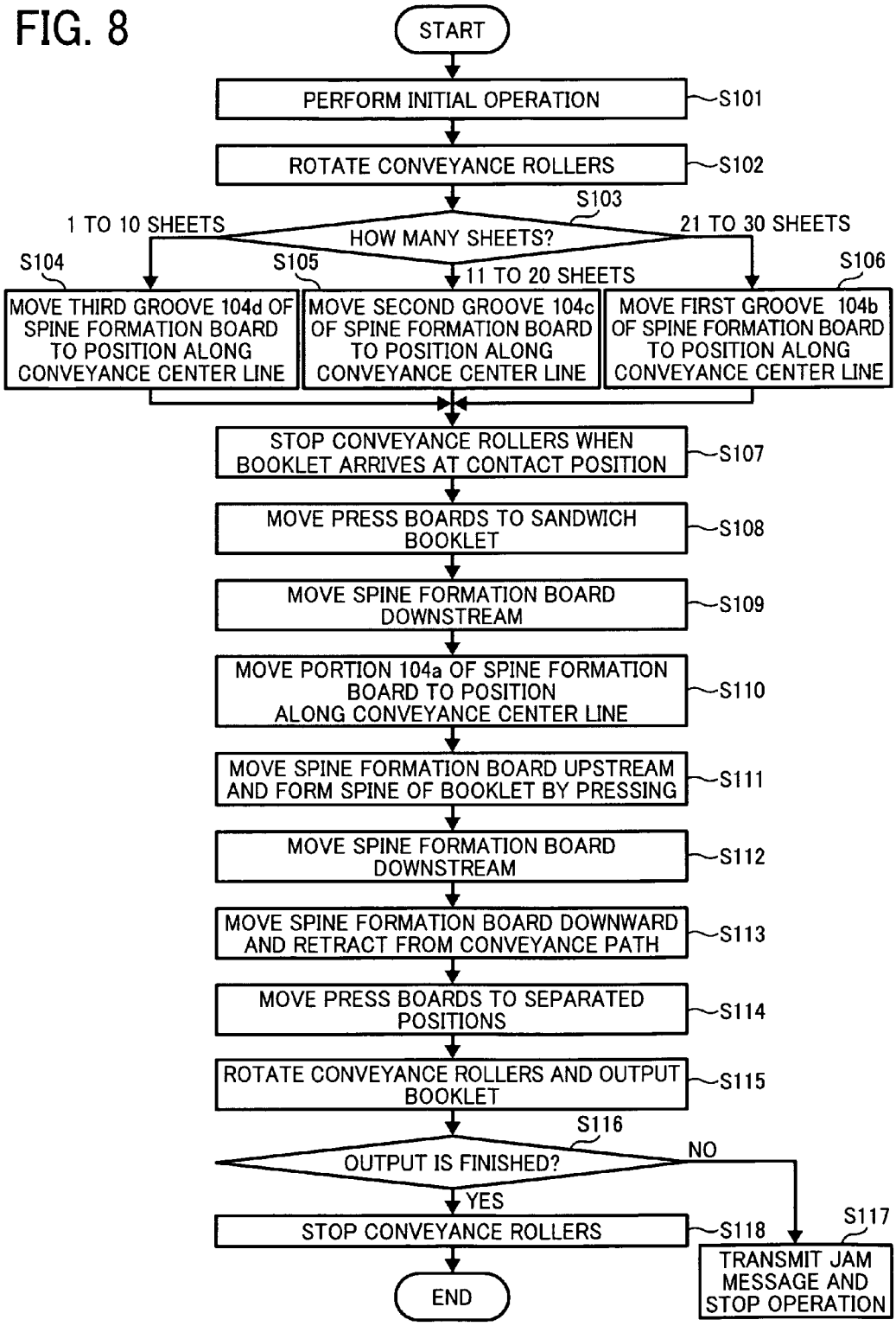
FIG. 8 is a flowchart illustrating a process of operations executable in the spine formation device.

FIGS. 2 to 7 are schematic views illustrating operations of the spine formation device 1000 illustrated in FIG. 1. FIG. 8 is a flowchart illustrating a process of operations of the spine formation device 1000.

Figure 2:
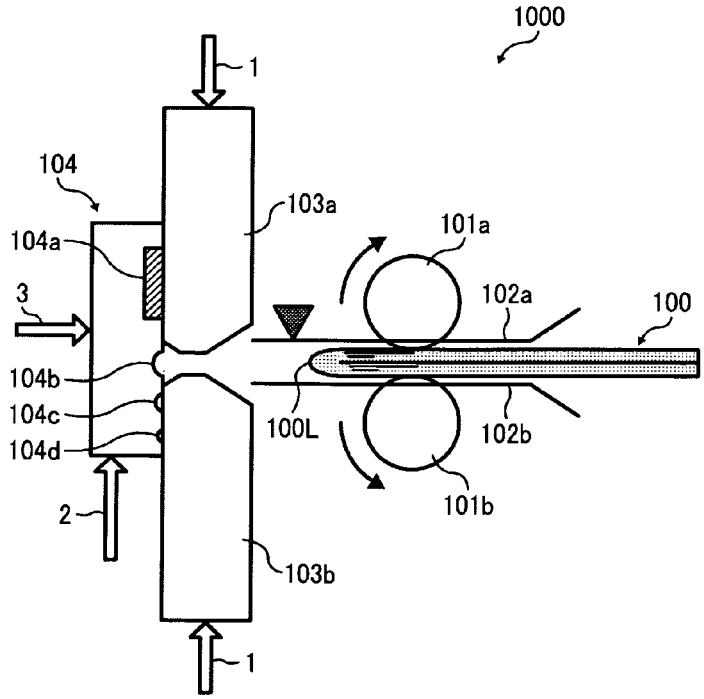
FIG. 2 is a schematic view illustrating operations and a state of the spine formation device illustrated in FIG. 1 before a booklet goes between press boards.
Figure 3:
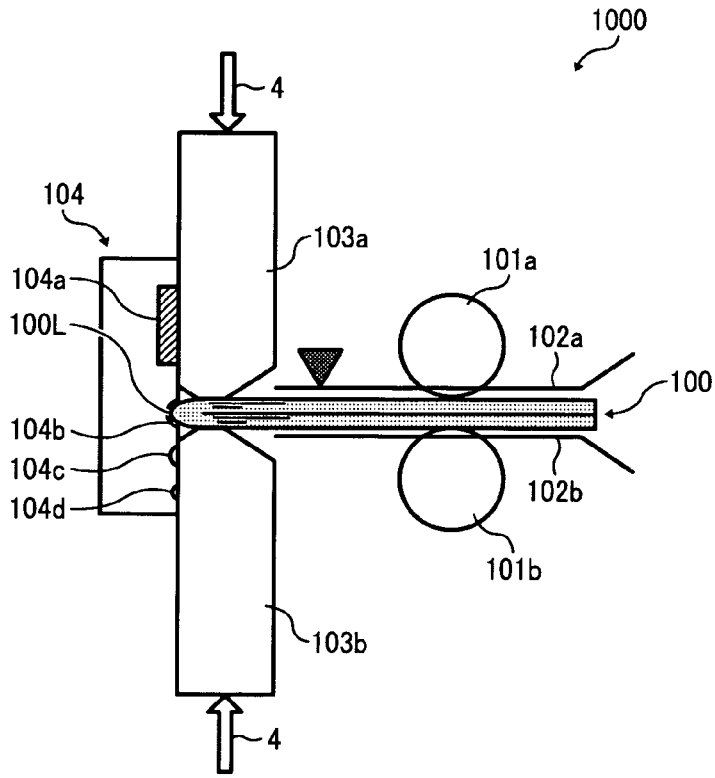
FIG. 3 is a schematic view illustrating an operation and a state of the spine formation device illustrated in FIG. 1 when the booklet goes between the press boards.
Figure 4:
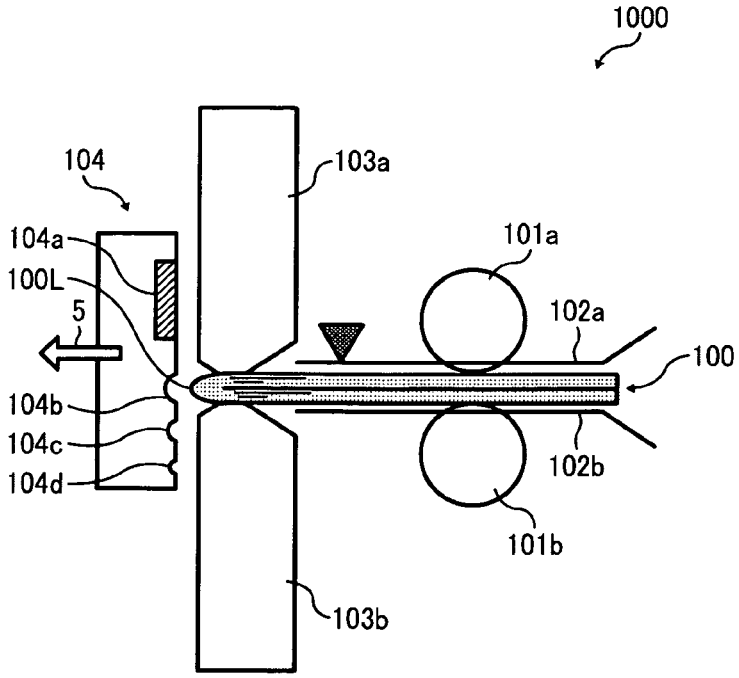
FIG. 4 is a schematic view illustrating an operation and a state of the spine formation device illustrated in FIG. 1 when a front end portion of the booklet is sandwiched with the press boards.
Figure 5:
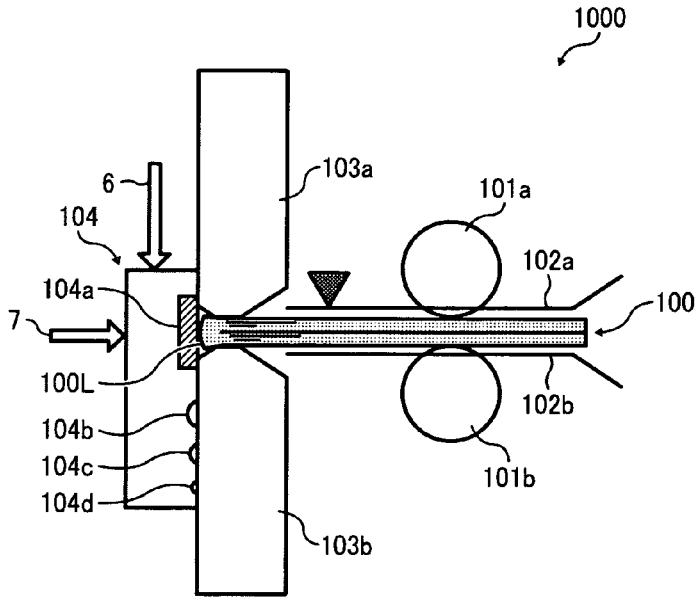
FIG. 5 is a schematic view illustrating operations and a state of the spine formation device illustrated in FIG. 1 when a spine is formed at the front end portion of the booklet.

The spine formation device 1000 introduces a booklet 100 from the guide plates 102 and outputs the booklet 100 by performing the operations illustrated in FIGS. 2 to 7. When the front end of the booklet 100 is positioned as illustrated in FIGS. 2 and 3, the position of the spine formation board 104 in the sheet conveyance direction remains the same as when a spine of the booklet is formed as illustrated in FIG. 5. In the present illustrative embodiment, as described above, the spine formation board 104 includes three types of positioning grooves: the first positioning groove 104*b* for 1 to 10 sheets, the second positioning groove 104*c* for 11 to 20 sheets, and the third positioning groove 104*d* for 21 to 30 sheets. It is to be noted that the number of types of positioning grooves is not limited to three and may be any other suitable number. The number of grooves and the association of grooves with available numbers of sheets are set in response to a booklet conveyed. Processing with the third positioning groove 104*d*, the second positioning groove 104*c*, and the first positioning groove 104*b* correspond to processing at S104, S105, and S106, respectively, described below with reference to FIG. 8.

In FIGS. 2 to 7, operations performed when the booklet 100 contains 30 sheets are illustrated.

As one example, the positioning grooves 104*b* to 104*d* may be automatically switched according to information on the number of sheets of the booklet conveyed. Alternatively, the positioning grooves 104*b* to 104*d* may be switched according to an external input value entered with an operation-and-input unit such as an operation panel. In FIG. 8, selection and switching of the positioning grooves 104*b*, 104*c*, and 104*d* are performed according to determination results at S103 of the number of sheets to be bound.

In performing spine formation, as illustrated in FIG. 8, an initial operation is performed at S101, the press boards 103*a* and 103*b* move to respective booklet-receive positions, and the conveyance rollers 101*a* and 101*b* are positioned so as to be ready for receiving a booklet 100. Then, the conveyance rollers 101*a* and 101*b* start rotating at S102 to feed the booklet 100 from the guide plates 102*a* and 102*b*. At S103, information on the number of sheets to be bound as the booklet 100 is acquired from an image forming apparatus, not illustrated, and at S104, S105, and S106 the positioning grooves 104*b*, 104*c*, and 104*d* are positioned according to the information acquired. In this example, as described above, since the number of sheets of the booklet 100 is assumed to be 30 sheets, the process goes to S106.

At S106, before the booklet 100 goes between the press boards 103*a* and 103*b*, the press boards 103*a* and 103*b* move toward each other up to a predetermined distance as indicated by an arrow 1 in FIG. 2. Then, as indicated by an arrow 2, the spine formation board 104 moves from the position illustrated in FIG. 1 to a position at which the first positioning groove 104*b* opposes the exit of the press boards 103, and moves to contact the rear side of the press boards 103 as indicated by an arrow 3 of FIG. 2. From this state, as illustrated in FIG. 3, the conveyance rollers 101 convey the booklet 100 into a gap between the press boards 103. At S107, when a front end portion 100L of the booklet 100 contacts the first positioning groove 104*b*, the conveyance rollers 101 stop. At S108, the press boards 103 are pushed toward each other, i.e., in directions indicated by arrows 4 of FIG. 3 to hold the booklet 100.

Figure 6:
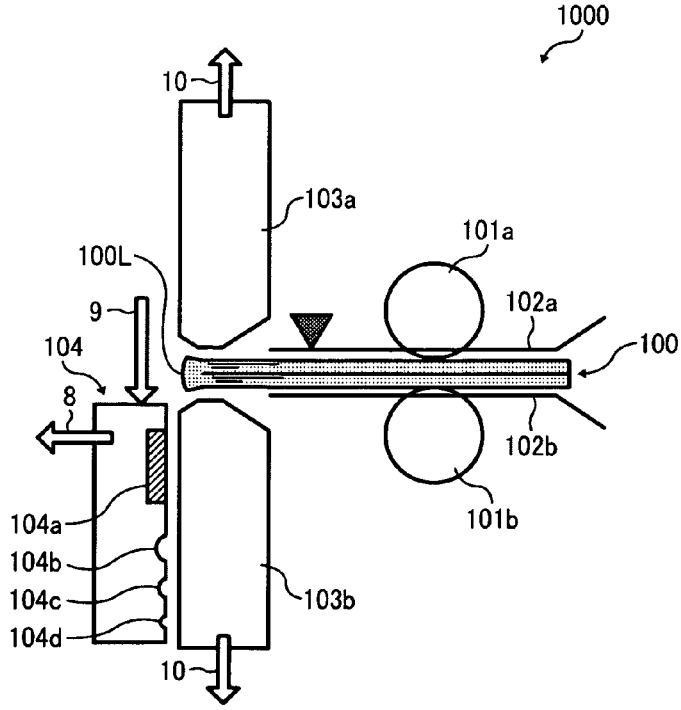
FIG. 6 is a schematic view illustrating operations and a state of the spine formation device illustrated in FIG. 1 after the formation of the spine has been finished finished.
Figure 7:
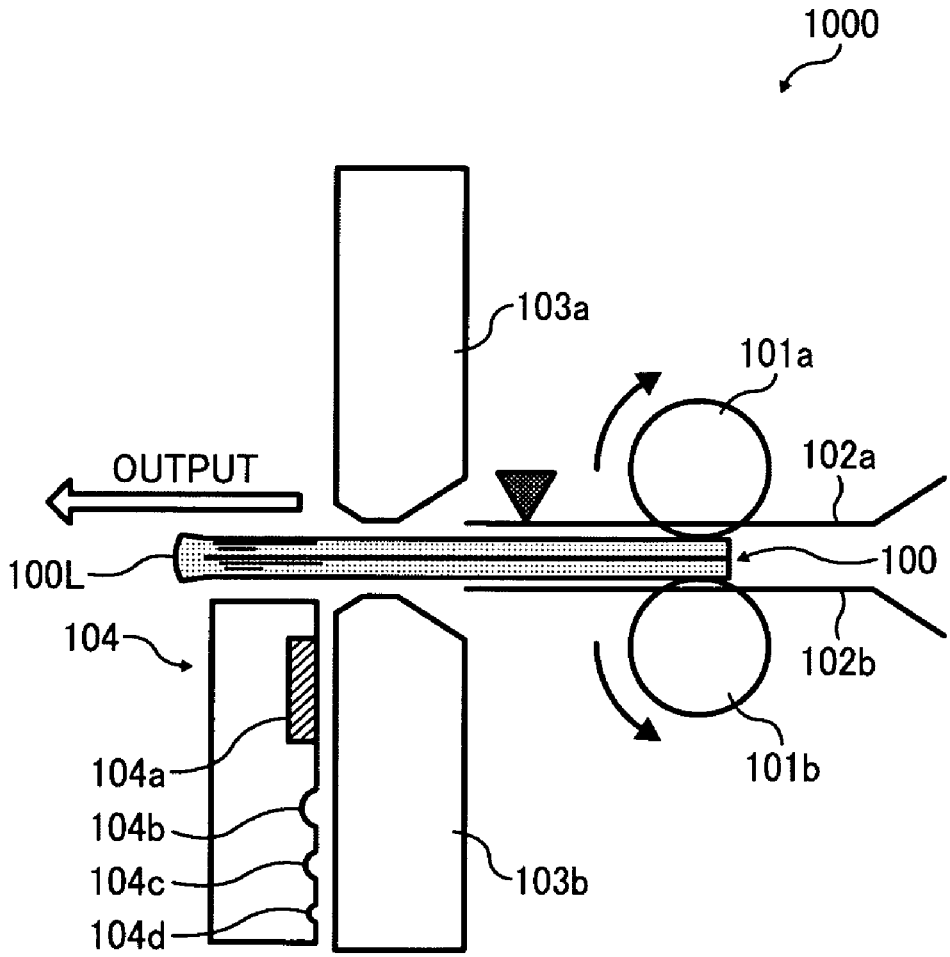
FIG. 7 is a schematic view illustrating an operation and a state of the spine formation device illustrated in FIG. 1 when the booklet is outputted.

Next, as illustrated in FIG. 4, at S109 the spine formation board 104 moves in a direction indicated by an arrow 5 toward the downstream side in the booklet conveyance direction. At S110, as illustrated in FIG. 5, the spine formation board 104 moves down in a direction indicated by an arrow 6 to a position at which the spine formation face 104*a* opposes the front end portion 100L of the booklet 100. At S111, the spine formation board 104 moves in a direction indicated by an arrow 7 toward the upstream side of the booklet conveyance direction and is pressed against the rear side of the press boards 103. Thus, the front end portion 100L of the booklet 100 is pressed by the spine formation board 104 and deformed along a cross-sectional shape of the press boards 103 to form a spine of the booklet 100. When the spine formation is finished, as illustrated in FIG. 6, at S112 the spine formation board 104 moves in a direction indicated by an arrow 8 and is separated from the press boards 103. At S113, the spine formation board 104 moves down in a direction indicated by an arrow 9 illustrated in FIG. 6. At S114, the press boards 103*a* and 103*b* move to predetermined separated positions. Thus, the spine formation process is finished. At S115, the booklet 100 is conveyed by the conveyance rollers 101 and outputted from the press boards 103. At S116, it is determined whether the output operation of the booklet 100 has been finished. If the output operation has not been finished ("NO" at S116), at S117 operations of the entire system including the spine formation device are stopped. Alternatively, if the output operation has been finished ("YES" at S116), at S118 the conveyance rollers 101 are stopped, and the process ends.

In the above-described determination step at S103, if the number of sheets to be bound is 1 to 10 sheets, at S104 the third positioning groove 104*d* moves to a position along the conveyance path of the booklet 100, e.g., a position along a conveyance center line of the booklet 100 conveyed by the conveyance rollers 101. Alternatively, if the number of sheets to be bound is 11 to 20, the second positioning groove 104*c* moves to a position along the conveyance path of the booklet 100, e.g., a position along a conveyance center line of the booklet 100 conveyed by the conveyance rollers 101. Then, the above-described process of S7 and subsequent steps is executed.

In the spine formation device 1000 of the above-described configuration, the spine formation board 104 has a length covering a length of the spine of the booklet 100 and spreads the front end portion 100L of the booklet 100 into a substantially-closed deformation space at the exit side of the press boards 103. Thus, the spine of the booklet 100 is formed in a substantially flat shape at the front end portion 100L of the booklet 100 with the spine formation face 104*a* serving as a spine formation portion.

Figure 9:
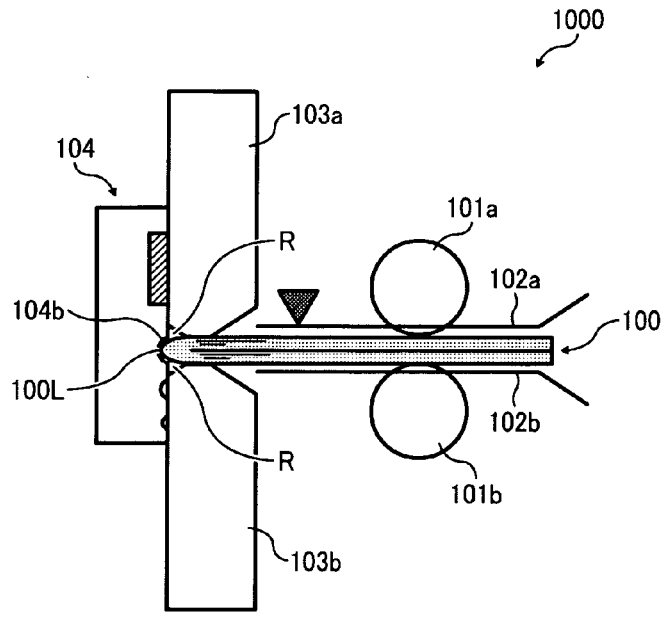
FIG. 9 is a schematic view illustrating an example of a deformation space formed during the operation illustrated in FIG. 5.

FIG. 9 is a schematic view illustrating the above-described deformation space.

In FIG. 9, the shape of two rooms "R" surrounded by the first positioning groove 104*b* of the spine formation board 104, the press boards 103*a* and 103*b*, and the booklet 100 is defined so that a total cross-sectional area of two rooms "R" is greater than a cross-sectional area of the first positioning groove 104*b*. For such a configuration, in the spine formation illustrated in FIG. 5, the front end portion 100L of the booklet 100 is forced into the rooms "R" and deformed along the shape of the rooms "R", thus forming a well-looking spine shape.

Figure 10:
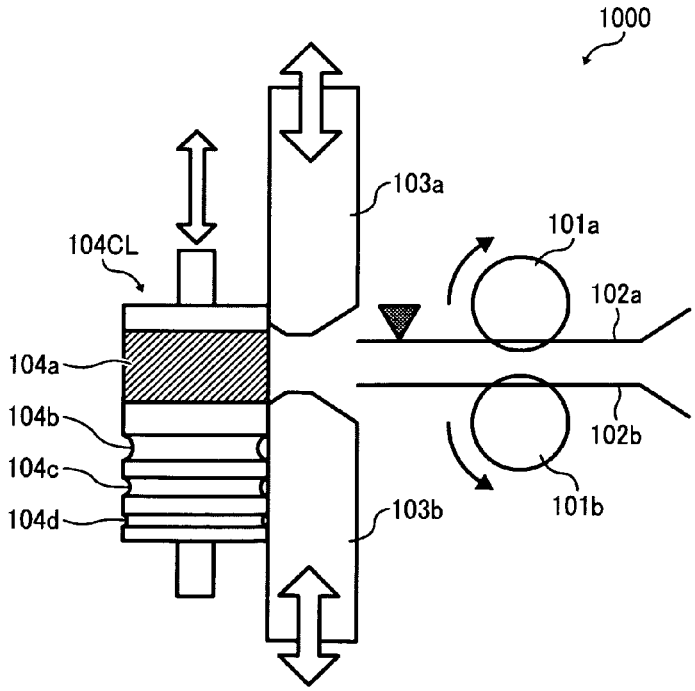
FIG. 10 is a plan view illustrating a configuration of the spine formation device that forms a spine of a booklet with a spine formation cylinder.
Figure 11:
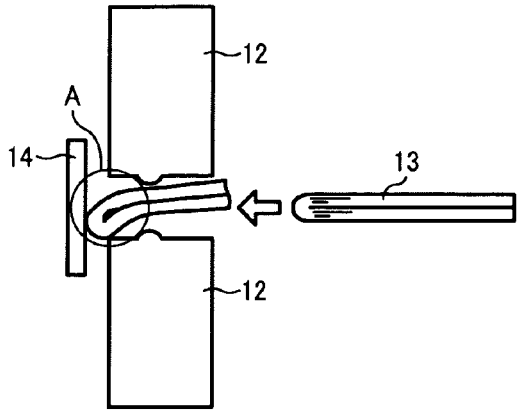
FIG. 11 RELATED ART
FIG. 11 is a schematic view illustrating an operation of a conventional type of spine formation device.
Figure 12:
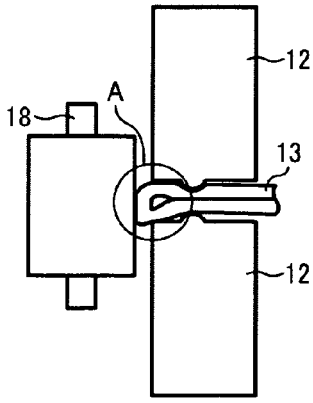
FIG. 12 RELATED ART
FIG. 12 is a schematic view illustrating an operation and a state of a conventional type of spine formation device during formation of a spine of a booklet.
Figure 13:
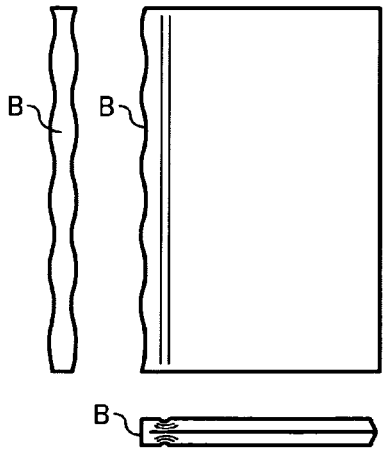
FIG. 13 RELATED ART
FIG. 13 is a schematic view illustrating an example of a spine formed by a conventional type of spine formation device.

In FIG. 10, as the spine formation member, a spine formation cylinder 104CL is employed instead of the spine formation board 104. As described above, in the spine formation board 104, the spine forming portion 104*a* of a straight shape (along a vertical direction in FIG. 1) and the first to three positioning grooves 104*b* to 104*d* are formed on the side of the spine formation board 104 opposing the press boards 103. By contrast, the spine formation cylinder 104CL includes the spine formation face 104*a*, the first positioning groove 104*b*, the second positioning groove 104*c*, and the third positioning groove 104*d* formed in a ring shape along the outer peripheral surface. Further, as described above, the spine formation board 104 moves toward and away from the press boards 103 by the reciprocating linear motion. By contrast, the spine formation cylinder 104CL presses the front end portion 100L of the booklet 100 while moving in the longitudinal direction of the front end portion 100L to from a spine of the booklet 100 in a process similar to that described in FIG. 8.

In this example, since the spine formation cylinder 104CL forms the spin face of the booklet 100 while moving on a spine portion of the booklet 100 in the longitudinal direction of the booklet 100, the load in the spine formation is reduced. Accordingly, even if the strength with which the press boards 103 holds the booklet 100 is not so great, the spine formation is successfully performed, allowing a reduction in manufacturing cost. It is to be noted that the spine formation board 104 may be advantageous over the spine formation cylinder 104CL in productivity since the spine formation board 104 needs less moving time.

The spine formation device 1000 illustrated in FIG. 1 or 10 is operatively provided with or mounted in an apparatus capable of processing a bundle of sheets or a booklet, such as a saddle-stitch bookbinding apparatus having a saddle-stitch mechanism, a sheet-edge cutting apparatus having a sheet-edge cutting mechanism, or an image forming apparatus.

As described above, the spine formation device according to the present illustrative embodiments includes the press boards 103 that press the front end portion 100L of the booklet 100 and the spine formation board 104 (or the spine formation cylinder 104CL) having the spine forming portion 104*a* that forms a spine at a folded portion of the booklet 100 and the first to third positioning grooves 104*b* to 104*d* that position the booklet 100 to define the amount by which the booklet 100 protrudes from the press boards 103. As the spine of the booklet 100 is formed with the press boards 103 and the spine formation board 104, the spine of the booklet 100 is formed along a flat shape of the spine formation board 104, thus preventing deformation and waving of the spine shape.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. A spine formation device comprising:

a sheet conveyer that conveys a bundle of folded sheets with a folded portion of the bundle of folded sheets forming a front end portion of the bundle of folded sheets;

a presser disposed downstream from the sheet conveyer in a sheet conveyance direction in which the sheet conveyer conveys the bundle of folded sheets, the presser movable to press opposed sides of the front end portion of the bundle of folded sheets conveyed with the sheet conveyer; and a spine formation member movably disposed downstream from the presser in the sheet conveyance direction, the spine formation member comprising a groove portion and a spine formation face, the groove portion contacting and positioning the bundle of folded sheets to define an amount by which the bundle of folded sheets protrudes from the presser, the spine formation face forming a spine at the folded portion of the bundle of folded sheets.

2. The spine formation device according to claim 1, further comprising:

a first drive unit that moves the spine formation member in a thickness direction of the bundle of folded sheets perpendicular to the sheet conveyance direction;

a switcher that switches positions of the groove portion and the spine formation face relative to the front end portion of the bundle of folded sheets; and a second drive unit that moves the spine formation member in the sheet conveyance direction in which the bundle of folded sheets is conveyed with the sheet conveyer.

3. The spine formation device according to claim 2, wherein a position of the spine formation member at which the spine formation member positions the bundle of folded sheets in the sheet conveyance direction is identical to a position of the spine formation member at which the spine formation member forms the spine at the folded portion of the bundle of folded sheets.

4. The spine formation device according to claim 2, wherein the groove portion of the spine formation member includes a plurality of grooves and the switcher switches positions of the plurality of grooves according to the number of sheets contained in the bundle of folded sheets.

5. The spine formation device according to claim 1, wherein, in a state in which the bundle of folded sheets is positioned with the groove portion and pressed with the presser, the spine formation member, the presser, and the bundle of folded sheets together define a space having a cross-sectional area greater than a cross-sectional area of the groove portion.

6. A saddle-stitch bookbinding apparatus, comprising:

a saddle stitcher that stitches a bundle of folded sheets; and the spine formation device according to claim 1.

7. A sheet-edge cutting apparatus, comprising:

a sheet-edge cutter that cuts a bundle of folded sheets; and the spine formation device according to claim 1.

8. An image forming apparatus comprising a spine formation device, the spine formation device comprising:

a sheet conveyer that conveys the bundle of folded sheets with a folded portion of the bundle of folded sheets forming a front end portion of the bundle of folded sheets;

a presser disposed downstream from the sheet conveyer in a sheet conveyance direction in which the sheet conveyer conveys the bundle of folded sheets to accommodate the bundle of folded sheets, the presser movable to press opposed sides of the front end portion of the bundle of folded sheets; and a spine formation member movably disposed downstream from the presser in the sheet conveyance direction, the spine formation member comprising a groove portion and a spine formation face, the groove portion contacting and positioning the bundle of folded sheets to define an amount by which the bundle of folded sheets protrudes from the presser, the spine formation face forming a spine at the folded portion of the bundle of folded sheets.

* * * * *